US005623880A

United States Patent [19]

Kuntz

[11] Patent Number: 5,623,880

[45] Date of Patent: Apr. 29, 1997

[54] BATHROOM SHELF

[76] Inventor: Charles H. Kuntz, 2008 Mapleton Dr., Centerville, Ohio 45459

[21] Appl. No.: 448,229

[22] Filed: May 13, 1995

[51] Int. Cl.[6] ..... A47B 37/00

[52] U.S. Cl. ..... 108/42; 242/598.1; 242/599.1; 211/90; 108/50

[58] Field of Search ..... 108/42, 47, 50, 108/90, 28, 29, 30, 16; 248/214; 242/598.1, 598.3, 599.1, 598.5; 211/90, 86

[56] References Cited

U.S. PATENT DOCUMENTS

| | | | |
|---|---|---|---|
| 1,064,843 | 6/1913 | Marsh | 108/15.2 |
| 2,473,744 | 6/1949 | Bulman | 242/598.5 |
| 3,837,595 | 9/1974 | Boone | 242/598.5 X |
| 3,943,859 | 3/1976 | Boone | 242/598.5 X |
| 4,181,382 | 1/1980 | Harvey | 248/214 X |
| 4,641,898 | 2/1987 | Horowitz et al. | 108/50 X |
| 4,798,312 | 1/1989 | Scheiber | 242/598.5 X |
| 4,827,849 | 5/1989 | Vignale | 248/214 X |
| 4,870,907 | 10/1989 | McKee | 108/42 |
| 5,311,986 | 5/1994 | Putz | 242/598.5 X |

*Primary Examiner*—Peter M. Cuomo
*Assistant Examiner*—Janet M. Wilkens
*Attorney, Agent, or Firm*—Joseph Patrick Burke, Esq.

[57] ABSTRACT

A positive action, self-leveling rear-tilting, centrally threadably, finger adjustable, stably positioned bathroom shelf, universally adjustable to fit most toilet tissue mounting rolls, which is mounted to straddle the mounting roll for a roll of toilet tissue. Arcuately-shaped lower surface portions of left and right vertical shelf mounting members are made to straddle outer portions of respective left and right side portions of the tissue mounting roll by finger adjustment (s) of the centrally positioned adjusting knob, e.g., using the thumb and index fingers.

15 Claims, 3 Drawing Sheets

L
10
11
21
28
51
20
29
17
26
25
15
19
12
52
13
31
38
13
14
37
33
30
32
16
46
23
44
50
22
27
18
40
45
39
47
43
42
48
49
41

BATHROOM SHELF

BRIEF DESCRIPTION OF THE INVENTION

The present invention is directed to a positive action, self-leveling, rear-tilting, centrally threadably, finger adjustable, stably positioned bathroom shelf, universally adjustable to fit most toilet tissue mounting rolls, which is mounted to straddle the mounting roll for a roll of toilet tissue. Arcuately-shaped lower surface portions of left and right vertical shelf mounting members are made to straddle outer portions of respective left and right side portions of the tissue mounting roll by finger adjustment(s) of the centrally positioned adjusting knob, e.g., using the thumb and index fingers.

BACKGROUND OF THE INVENTION AND PRIOR ART

For everyday use at home, or business and/or for those persons confined to hospital care and those undergoing geriatric care in homes and geriatric care providing establishments, it is convenient to be able to have a bathroom shelf on which to place ashtrays, books, extra toilet tissue rolls, beverages and meals while seated on the commode. Thus there is a need in such establishments, particularly, for an easily positioned and adjustable, stable bathroom shelf which can be readily adjusted using only two fingers, e.g., the thumb and index fingers, to position the bathroom shelf on a mounting roll for toilet paper. Several attempts have been made in the prior art patents to accomplish the desired objectives indicated above; but none have attained the extent of efficiency and functionality achieved by the present invention.

U.S. Pat. No. 3,943,859 issued on Mar. 16, 1976 to Philip Boone is directed to a compact shelf-like device which is stated to be readily attachable to a standard toilet-tissue dispenser without need of special tools. The device is stated to hold one or more toilet accessories conveniently.

U.S. Pat. No. 4,483,491 issued to James R. Rainey on Nov. 20, 1984, is directed to a dispensing holder for rolls of paper toweling or tissue which includes a wall-mountable frame (11) and a removable roll spindle supported at its ends in arcuate grooves (21) of the frame, and a shelf (17) on the frame for holding other objects conveniently thereon.

U.S. Pat. No. 4,825,779 issued to Kenneth B. Simms on May 2, 1989 is directed to a table, specialized for toilet use, which has a spindle with exceptional access supporting a roll of toilet paper, a table top supported by legs at a height and an angle optionally usable by one seated in the ordinary way on a flush toilet seat. An edge retains objects such as reading material on the inclined table top, and a platform with space slats supports reading material and the like between floor and toilet paper roll. The roll is stated to retract easily when pushed, so that any selected side of the table can be stored pushed against the wall.

U.S. Pat. No. 5,248,105 issued to John T. Cooker on Sep. 28, 1993 is directed to a toilet paper appliance for keeping printed materials and other articles off of the floor. The appliance has a horizontal shelf and a newspaper rack, both joined to a vertical support member. The vertical support member can be placed between a pair of forwardly extending arm members of a toilet paper dispenser to combine the appliance with a dispenser. To mount the appliance to a wall, the vertical member has holes therein for screws to pass through. The appliance can include vertical hangers to support a roll of toilet paper and eliminate the need for a separate paper dispenser.

U.S. Pat. No. 5,311,986 issued to Joan M. Putz on May 17, 1994 is directed to a dispensing device for providing pre-moistened wipes from the conventional toilet tissue roll holder so that dry and moist cleaning material is available from the same convenient location. The dispensing device contains an upper container section with side walls and back wall extending underneath the container section. Lid exit is provided in the end wall of the container section for removal of pre-moistened wipes. Sufficient space is provided underneath the container section for placement of a toilet tissue roll between the lower side walls and the back wall. Mounting holes provided in the lower side walls allow mounting the dispenser on the roll holder spindle. The dispensing device conveniently provides pre-moistened wipes in the space above the toilet tissue roll.

U.S. Pat. No. Des. 266,718 issued to Lawrence Peabody, et al, on Nov. 2, 1982 shows a front perspective view of a combined paper towel holder and shelf. There are six views taken from various positions of the Peabody, et al, combined paper towel holder and shelf.

U.S. Pat. No. Des. 305,488 issued to E. Pekka Korpijaako, on Jan. 16, 1990 is directed to an ornamental design for a combined toilet paper holder and shelf, which is shown and described in six figures showing the device from various positions.

DETAILED DESCRIPTION OF THE INVENTION

Figure 1:
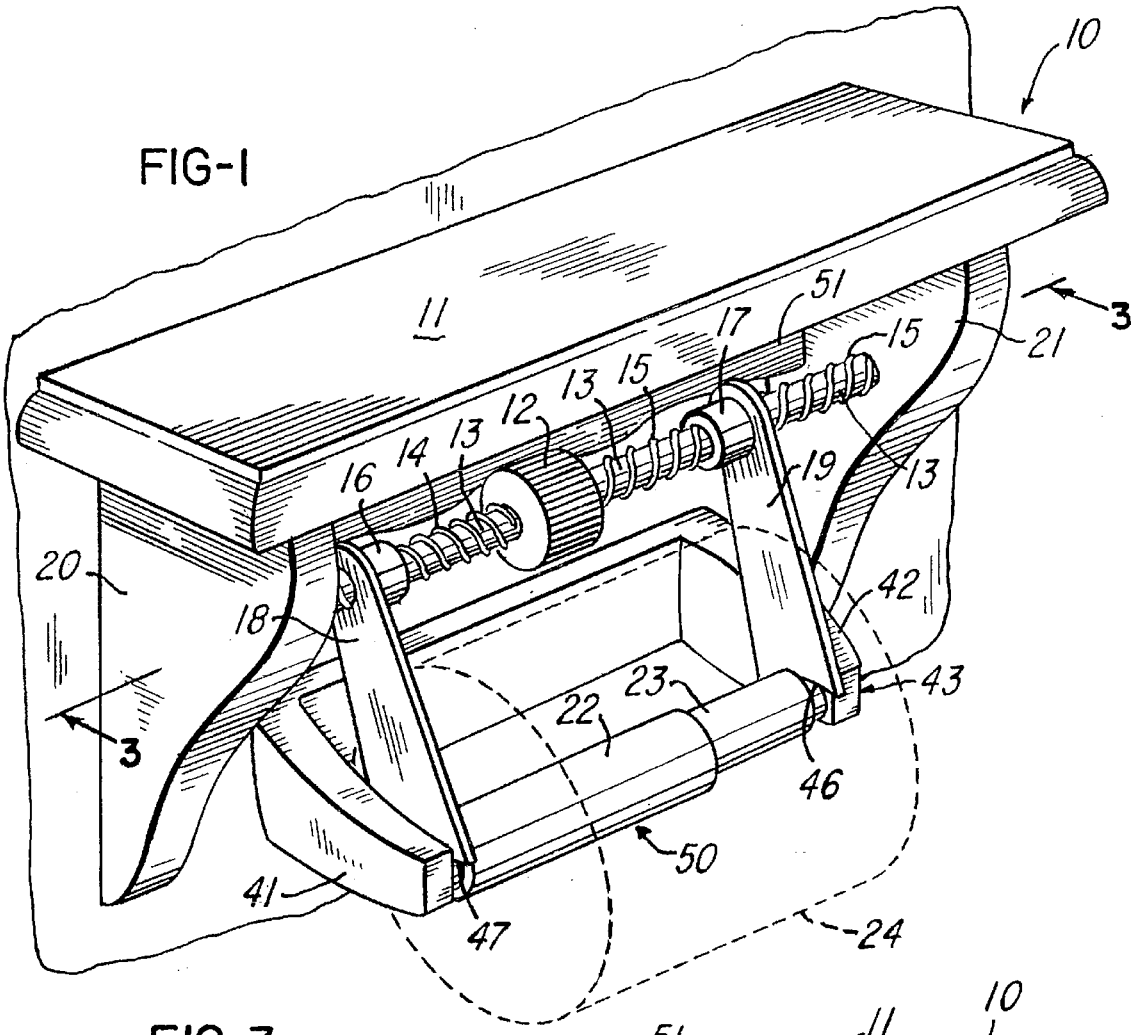
FIG. 1 is a front left side perspective view with a portion in phantom line illustrating the environment of use of the present invention.

The present invention is useful for mounting with respect to all toilet tissue holders which position the tissue mounting roll from about two-and-one-half inches to about three inches from a bathroom wall to accommodate the tissue roll. This assures that the bathroom shelf of this invention will work properly.

As will be apparent from FIGS. 1 through 4 of the drawings, the bathroom shelf of this invention (10) has a top shelf portion (11), a left vertical support portion (20), a right vertical support portion (21) and a back portion (51). As shown in FIGS. 1 through 4, inclusive, a central, width-adjusting knob (12) is present to permit lateral adjustment of components (18) and (19). Preferably this adjusting knob is splined to permit ready adjustment using the thumb and forefinger of one hand. Most preferably, the direction of splines (52) is parallel to the long axis (L) of shelf top (11). See FIG. 2. As shown in FIGS. 1 through 5, a threaded axle (13) contains left-hand (counter-clockwise) threads (14) and right-hand (clockwise) threads (15).

At (16), there is shown a left female threaded sleeve and correspondingly at (17) a right female threaded sleeve. See FIGS. 1 through 4 regarding (16) and FIGS. 1 through 5 regarding (17). Bathroom shelf (10) contains a left vertical shelf-mounting member or portion (18) which fits on an exterior surface of mounting roll portion (22) as shown in FIGS. 1 through 4, inclusive. A corresponding right vertical shelf-mounting member or portion (19) fits on the exterior surface of mounting roll portion (23) as illustrated in FIGS. 1 through 5, inclusive.

As shown in FIGS. 1 through 4, there is a shelf top portion (11), a left vertical shelf support portion (20), a right vertical shelf support portion (21) and a back portion (51). These portions (11), (20), (21) and (51) are preferably integral and made of molded plastic, which can be provided with exterior surfaces having the grain and appearance of wood. However, these portions need not be integral. They can be actual wood or plastic components glued, or otherwise secured together, e.g., by dowels.

A roll of toilet tissue (24) is mounted on a mounting roll having its left side (22) and its right side (23), as shown in FIGS. 1 through 5, inclusive, for (22) and FIGS. 1, 3, 4, and 5 for (23).

Figure 2:
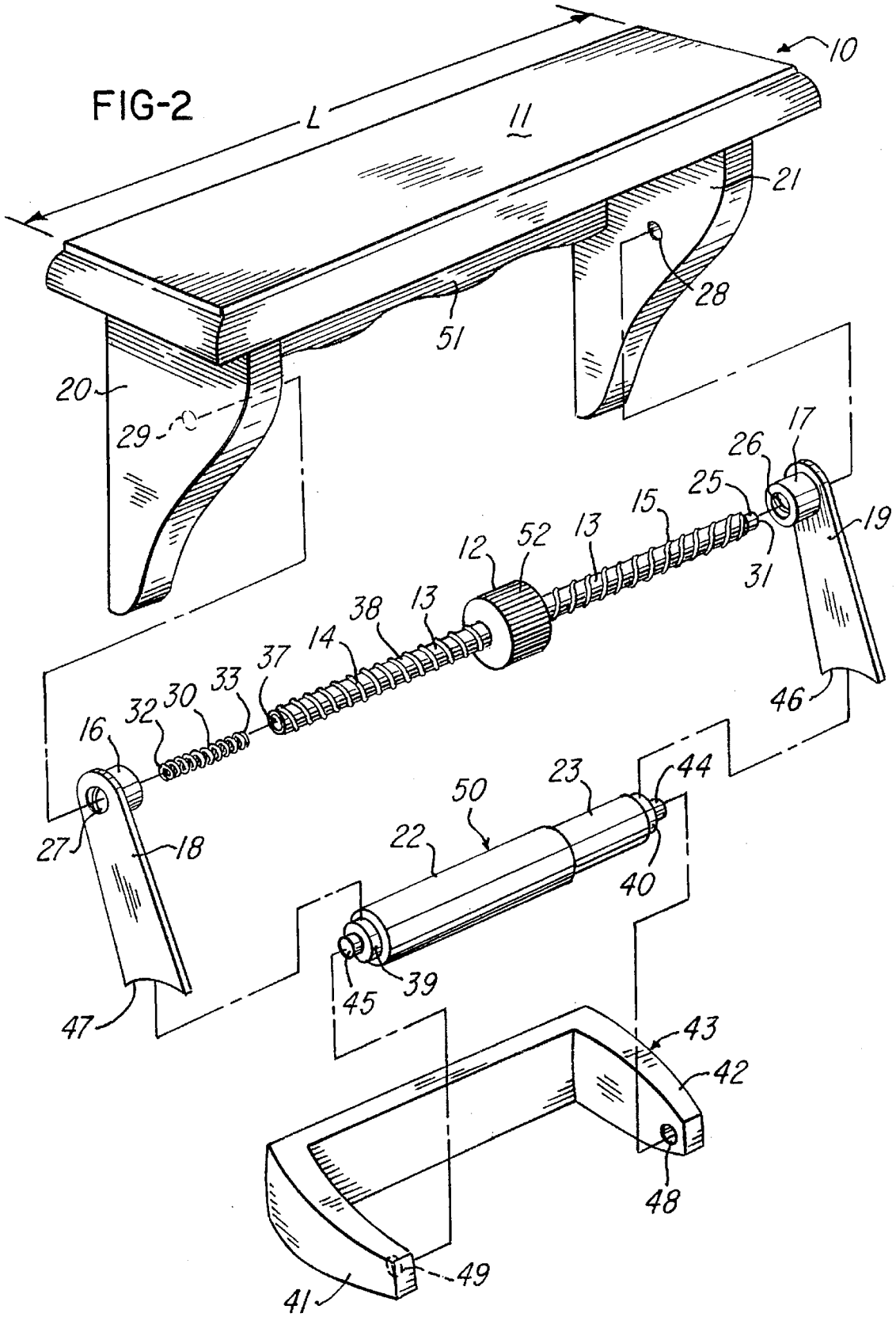
FIG. 2 is an isometric view illustrating the present invention and particularly the long axis (L) of shelf top (11).
Figure 4:
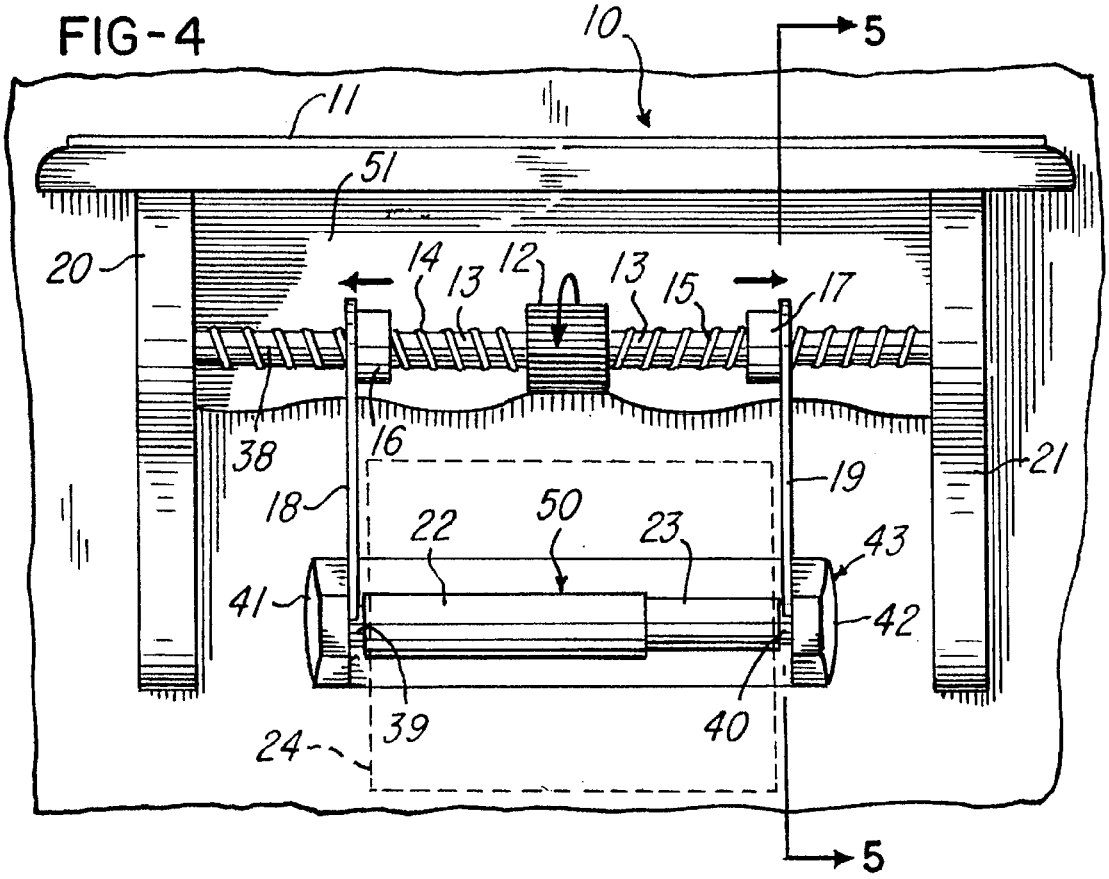
FIG. 4 is a frontal plan view of the device of this invention mounted for use on a bathroom wall.

As is apparent from FIG. 2, the device of this invention has a stub (25) for inserting one end of threaded axle (13) in internal opening (26) of sleeve (17). Internal opening (26) is a complete opening throughout the extent of sleeve (17), and receives stub (25).

Figure 3:
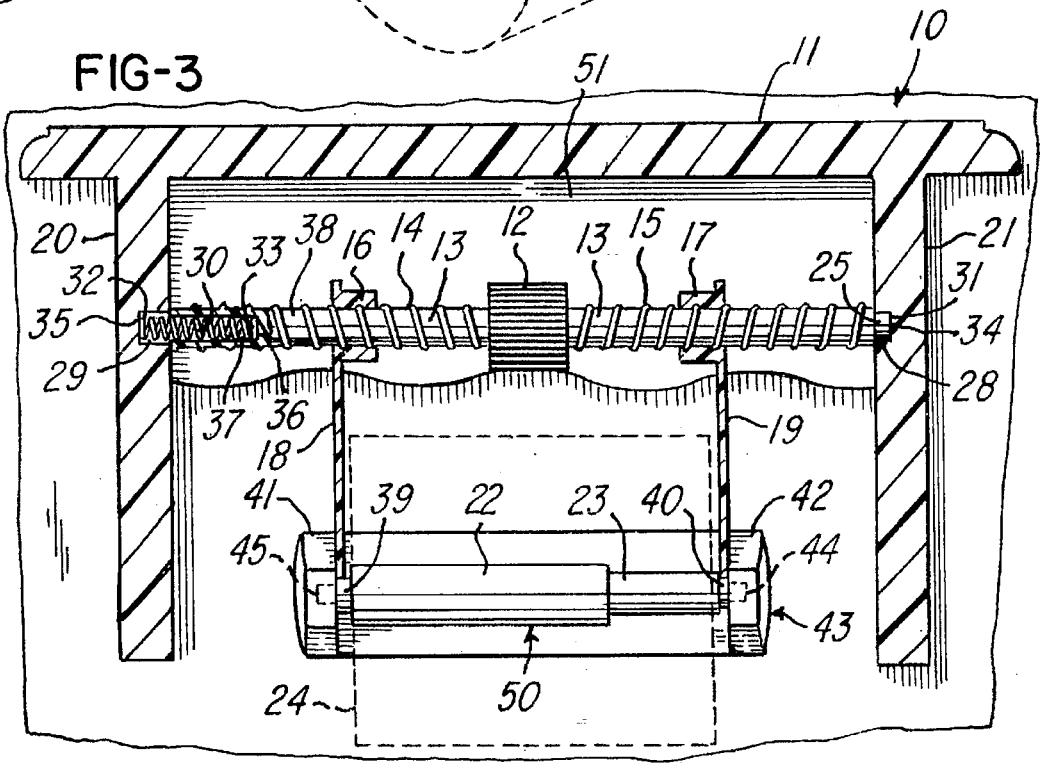
FIG. 3 is a partial cross-sectional frontal view with parts in section and portion in phantom line illustrating the present invention, particularly with respect to the mounting of a coil spring internally within a threaded axle.

As shown in FIGS. 2 and 3 of the drawings, there exists a complete opening (27) which is an internal opening in the sleeve (16) for receiving coil spring (30).

Partial opening (28) in the inwardly facing surface of right vertical shelf support (21) against which the end (31) of stub (25) abuts at surface (34) and partial opening (29) is present in the inwardly facing surface of left vertical shelf support (20) against which the left side end coil (32) of coil spring (30) abuts at surface (35). It will be observed from FIG. 3 that partial opening (29) is deeper within left vertical shelf support (20) than is partial opening (28) in right vertical shelf support (21) to allow the right side stub portion (25) to be inserted first.

As shown in FIGS. 2 and 3, stub (25) terminates in its end (31).

It will be observed from FIG. 2 that left side end coil (32) of coil spring (30) is present within the partial opening (29) whereas the right side end coil (33) of coil spring (30) is present within partial opening (37).

As shown in FIG. 3, there is an internal abutment surface (34) within partial opening (28) in right vertical shelf support (21) and a corresponding internal abutment surface (35) within partial opening (29). An additional internal abutment surface (36) is provided within the right-hand side of partial opening (37) which has a lesser internal diameter than that of opening (29). This abutment surface (36) also faces the left-hand side (38) of threaded axle (13).

As is apparent from FIGS. 1 through 4, inclusive, which illustrate one commonly used tissue roll and mounting bracket, the left side, (22) of the toilet tissue mounting roll (50) has an outer portion (39) of reduced diameter. Correspondingly the right side outer portion of mounting roll portion (23) has its reduced diameter portion (40).

Tissue roll mounting bracket (43) has its left side portion (41) and its right side portion (42).

As shown in FIGS. 2 and 3, the right side reduced diameter portion (40) has its outwardly-biased right stub (44) and the corresponding left-side reduced diameter portion (39) has its outwardly-biased stub portion (45).

Figure 5:
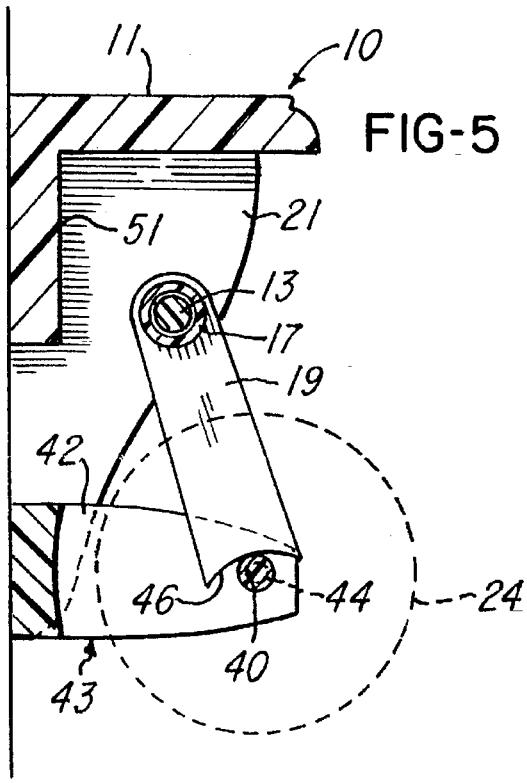
FIG. 5 is a partial cross-sectional view with parts in section and parts in phantom line taken along the line 5—5 of FIG. 4.

As illustrated in FIGS. 1, 2, and 5, arcuately-shaped lower surface portion (46) of (19) and arcuately-shaped lower surface portion (47) of (18) provide bearing surfaces for positioning the device of the present invention on the respective reduced-diameter portions (40) and (39) on the respective right and left sides of the tissue mounting roll (50).

As shown in FIG. 2, the partial opening (48) in (42) allows for reception of stub (44) whereas partial opening (49) of (41) permits reception of the stub (45) in (41).

Thus there has been provided a bathroom shelf universally adjustable to fit most toilet tissue mounting rolls, e.g., (50) currently in use. This shelf (10) has a positive action, self-leveling, rear tilt and is stably positioned against a bathroom wall in the vicinity of a commode. A centrally located splined adjustment knob (12) assures positioning, viz., alignment, centering and maintaining, of shelf vertical mounting members (18) and (19) along a threaded axle (13) to align the concave arcuate lower surfaces (47) and (46) of these vertical mounting members with the convex upper surfaces of reduced diameter outer portions (39) and (40) of a typical toilet tissue mounting roll (50).

The adjusting vertical mounts maintain their position when changing the toilet tissue roll. A quick lifting of the shelf, changing of the tissue and repositioning of the shelf are accomplished in seconds.

I claim:

1. A bathroom shelf apparatus universally adjustable to fit most toilet tissue mounting rolls comprising a bathroom shelf having a positive self-leveling rear tilt positioning it stably against a bathroom wall in the vicinity of a commode, paid tilt comprising vertical mounting members, each having arcuate lower surfaces and being mounted on a threaded axle having counter-clockwise and clockwise threads, and an adjusting knob centrally located on said axle between said vertical mounting members providing lateral adjustment thereof responsive to finger pressure to cause alignment, centering and maintaining of said arcuate lower surfaces on outer portions of most toilet tissue mounting rolls.

2. A bathroom shelf apparatus as in claim 1 wherein said arcuate lower surfaces are concave.

3. A bathroom shelf apparatus as in claim 1 wherein said shelf has a top portion, back portion and vertical shelf support portions.

4. A bathroom shelf apparatus as in claim 3 wherein said shelf top, back and vertical shelf support portions are either integral or separate wood or plastic components.

5. A bathroom shelf apparatus as in claim 4 wherein said shelf top, back and vertical shelf support portions are plastic provided with exterior surfaces having the grain and appearance of wood.

6. A bathroom shelf apparatus as in claim 3 wherein said shelf top, back and vertical shelf support portions are separate components secured together.

7. A bathroom shelf apparatus as in claim 6 wherein said separate components are wood.

8. A bathroom shelf apparatus as in claim 6 wherein said separate components are plastic.

9. A bathroom shelf apparatus as in claim 3 wherein said adjusting knob is splined.

10. A bathroom shelf apparatus as in claim 9 wherein said shelf top has a long axis and said splines are parallel to the shelf top long axis.

11. A bathroom shelf apparatus as in claim 3 wherein said threaded axle has ends which are mounted within partial openings in said vertical shelf support portions.

12. A bathroom shelf apparatus as in claim 11 wherein said partial openings are located within inwardly facing surfaces of said vertical support portions.

13. A bathroom shelf apparatus as in claim 12 wherein a coil spring is located between one end of said threaded axle and its partial opening in one of said vertical shelf support portions.

14. A bathroom shelf apparatus as in claim 13 wherein each vertical mounting member has a sleeve at its upper portion, each such sleeve having an opening through which an end of said threaded axle passes.

15. A bathroom shelf apparatus as in claim 12 wherein said inwardly facing surfaces include a left partial opening and a right partial opening and said left partial opening is deeper within its vertical shelf support than is said right partial opening.

* * * * *